US008844500B2

(12) United States Patent
Bedekar et al.

(10) Patent No.: US 8,844,500 B2
(45) Date of Patent: Sep. 30, 2014

(54) ENCLOSURE FOR HIGH PRESSURE FUEL RAIL

(75) Inventors: Sarang R. Bedekar, Columbus, IN (US); Ron Hale, Columbus, IN (US); Todd S. Manley, Columbus, IN (US)

(73) Assignee: Cummins Intellectual Property, Inc., Minneapolis, MN (US)

( * ) Notice: Subject to any disclaimer, the term of this patent is extended or adjusted under 35 U.S.C. 154(b) by 425 days.

(21) Appl. No.: 13/356,099

(22) Filed: Jan. 23, 2012

(65) Prior Publication Data

US 2012/0210980 A1 Aug. 23, 2012

Related U.S. Application Data

(60) Provisional application No. 61/435,302, filed on Jan. 22, 2011.

(51) Int. Cl.

*F02M 69/50* (2006.01)
*F02M 55/02* (2006.01)
*F02M 55/00* (2006.01)

(52) U.S. Cl.

CPC ..... *F02M 55/025* (2013.01); *F02M 2200/16* (2013.01); *F02M 55/004* (2013.01)
USPC ..... 123/456; 123/469; 123/198 D

(58) Field of Classification Search

USPC ..... 123/445, 455, 456, 468–470, 198 D
See application file for complete search history.

(56) References Cited

U.S. PATENT DOCUMENTS

| | | | | |
|---|---|---|---|---|
| 4,149,568 | A | 4/1979 | Kuntz et al. | |
| 4,742,685 | A * | 5/1988 | Halvorsen et al. | 60/739 |
| 5,616,037 | A | 4/1997 | Larraine et al. | |
| 5,924,408 | A * | 7/1999 | van den Wildenberg | 123/450 |
| 6,135,092 | A * | 10/2000 | Schaenzer et al. | 123/456 |
| 6,227,170 | B1 | 5/2001 | Koshiba | |
| 6,499,466 | B2 | 12/2002 | Lee | |
| 6,827,065 | B2 | 12/2004 | Gottemoller et al. | |
| 6,928,984 | B1 | 8/2005 | Shamine et al. | |
| 7,146,700 | B1 * | 12/2006 | Darrah et al. | 29/419.2 |
| 7,252,071 | B2 | 8/2007 | Kochanowski et al. | |
| 7,337,652 | B2 | 3/2008 | Shamine | |
| 7,523,741 | B2 | 4/2009 | Kochanowski et al. | |
| 2005/0133008 | A1 * | 6/2005 | Zdroik et al. | 123/456 |

FOREIGN PATENT DOCUMENTS

| | | | |
|---|---|---|---|
| EP | 0 975 869 | B1 | 3/2002 |
| EP | 1 582 736 | B1 | 8/2008 |
| EP | 2 011 996 | A1 | 1/2009 |

* cited by examiner

*Primary Examiner* — John Kwon
*Assistant Examiner* — Johnny H Hoang
(74) *Attorney, Agent, or Firm* — Faegre Baker Daniels LLP

(57) ABSTRACT

The present disclosure provides an enclosure or containment assembly adapted to seal a high pressure fuel rail, and an engine system including such an enclosure or containment assembly. The assembly includes two portions that can sealingly engage to form an enclosure or compartment that contains the high pressure fuel rail. Fuel line connectors leading into the enclosure to ports of the high pressure fuel rail are in a sealing engagement with the enclosure to seal the high pressure fuel rail from the atmosphere and provide an enclosed low pressure region between the high pressure fuel rail and an inner surface of the enclosure. In this way, leaked fuel can be collected from the high pressure fuel lines and contained. The collected and contained leaked fuel can be channeled to a leak detector, which can trigger an alarm with detection of a leak.

17 Claims, 6 Drawing Sheets

ENCLOSURE FOR HIGH PRESSURE FUEL RAIL

CROSS REFERENCE TO RELATED APPLICATIONS

This application claims benefit of priority to Provisional Patent Application No. 61/435,302 filed on Jan. 22, 2011, the entire contents of this application being hereby incorporated by reference.

FIELD OF THE INVENTION

The invention relates to a high pressure fuel system, and more particularly, to a system including a high pressure fuel rail.

BACKGROUND

High pressure fuel delivery systems utilize a common rail (also known as a high pressure fuel rail, common rail, or accumulator) to accumulate and distribute fuel to fuel injectors at high-pressure while minimizing pressure fluctuations among the injectors. The high pressure fuel rail can be a single tube-like structure from which fuel is supplied to multiple injectors and functions as an accumulator to allow for precise control of high-pressure injection of fuel by an engine control unit (ECU) into the cylinders of an internal combustion engine at timing that is independent from the engine speed. Such high pressure fuel delivery systems, however, are susceptible to leakage from the high pressure fuel line or elsewhere in the delivery system. If fuel leakage occurs, the leaking fuel can spray onto high temperature surfaces of an engine and cause a fire. To safely deliver fuel in high pressure systems, modern fuel systems include measures to contain fuel leaks that may occur. For example, marine agency requirements such as the International Convention for the Safety of Life at Sea (SOLAS) treaty require double-walled fuel lines to prevent the likelihood of fire on a commercial marine vessel. These double-walled fuel lines must include a gap between the inner and outer walls to allow any fuel leaked from the inner wall to be detected by a fuel sensor while being contained by the outer wall.

SUMMARY

The present disclosure provides an enclosure or containment assembly adapted to seal a high pressure fuel rail, and an engine system including such an enclosure or containment assembly. The assembly includes two portions that can sealingly engage to form an enclosure or compartment that contains the high pressure fuel rail. Fuel line connectors leading into the enclosure to ports of the high pressure fuel rail are in a sealing engagement with the enclosure to seal the high pressure fuel rail from the atmosphere and provide an enclosed low pressure region between the high pressure fuel rail and an inner surface of the enclosure. In this way, leaked fuel can be collected, contained and detected. The leaked fuel can be channeled to a leak detector, which can trigger an alarm with detection of a leak. The enclosure or compartment can be integrated with fuel lines and fuel line connectors that include low pressure passages for returning leaked fuel along with high pressure passages for providing fuel to an upstream location, such as a fuel injector. The low pressure region of the enclosure can link with low pressure passages of the fuel lines to complete a low pressure circuit for the collection and detection of leaking fuel.

In one aspect of the disclosure, a containment assembly for a high pressure fuel system includes a first elongated portion having a first opening and adapted to receive a high pressure fuel rail having an elongated body, an inlet port, plural outlet ports, and a connecting member extending from the elongated body. The first elongated portion includes a fastener portion configured to secure the connecting member of the high pressure fuel rail within the opening of the first elongated portion, a fuel inlet port adapted to sealingly engage a high pressure fuel line connector that connects to the inlet the high pressure fuel rail, and a leaked fuel drain port adapted connect to a low pressure fuel leakage drain line upstream of a leak detector. The containment assembly includes a second portion adapted to cover and seal the first opening to form an enclosed compartment including a low pressure region between the high pressure fuel rail and inner surfaces of the compartment. The second portion includes plural ports, each of which is adapted to sealingly engage a respective high pressure fuel line connector including a high pressure fuel line and a low pressure passage, and to align with a high pressure outlet port of the high pressure fuel rail. With the plural fuel line connectors sealingly engaged with the respective plural ports, each low pressure passage of the high pressure fuel line connectors fluidly communicates with the enclosed low pressure region.

In another aspect of the disclosure, an engine system includes an internal combustion engine including plural cylinders and an intake manifold, a fuel system including a high pressure fuel rail having an inlet port and plural outlet ports, plural fuel injectors, where each of the injectors is adapted to inject fuel at high pressure into one of the cylinders, a high pressure fuel inlet line fluidly connected to the inlet port of the fuel rail, and plural high pressure fuel outlet lines. Each of the high pressure fuel outlet line is fluidly connected at a first end thereof to one of the fuel injectors and fluidly connected at a second end thereof to one of the outlet ports of the fuel rail. An enclosure housing the fuel rail includes a first elongated portion having an opening is provided along a direction of a longitudinal axis of the first elongated portion, a first surface surrounding the opening, a region recessed from the first surface, a second elongated portion having a second surface that sealingly engages with the first surface to cover and seal the opening, plural ports provided through the enclosure, each of the plural ports aligned with a corresponding one of the inlet port and the plural outlet ports of the enclosed high pressure fuel rail, and a leaked fuel drain port fluidly connected to a low pressure fuel leakage drain line. A leak detector fluidly is connected to the low pressure fuel leakage drain line downstream from the enclosure housing and is adapted to detect whether fuel is present in the low pressure fuel leakage drain line. Each of the high pressure fuel outlet lines and the high pressure fuel inlet lines include a connector at one end, a high pressure fuel passage, and a corresponding low pressure leaked fuel passage, and each of the connectors is sealingly engaged with the one of the plural ports of the enclosure to form a low pressure region in the enclosure substantially surrounding the high pressure fuel rail.

DETAILED DESCRIPTION

Various aspects are described hereafter in connection with exemplary embodiments to facilitate an understanding of the disclosure. However, the disclosure is not limited to these embodiments. Descriptions and depictions of well-known functions and constructions may not be provided for clarity and conciseness.

Embodiments are described herein using terms such as "upper" and "lower" when describing an orientation of the embodiment depicted in the figures. However, it is to be understood that such orientation language is utilized to describe specific exemplary embodiments, and that other embodiments consistent with the present disclosure are not limited to these depicted and described orientations. Further, the terms "high pressure" and "low pressure" are used herein as relative terms with respect to one another.

The inventors realized that to control fuel leakage when it does occur, a low pressure containment system in the form of a shroud (i.e., encapsulating) assembly can be used to form a cavity or enclosure into which the high pressure fuel accumulator (fuel rail) can be provided to channel leaking fuel to a containment tank or to return the leaking fuel to the fuel tank or the fuel pump. As described later in greater detail by way of exemplary embodiments, the encapsulating assembly encloses the high pressure fuel rail and seals the fuel rail completely, and also seals high pressure line connectors fluidly connected to the fuel rail.

Figure 1:
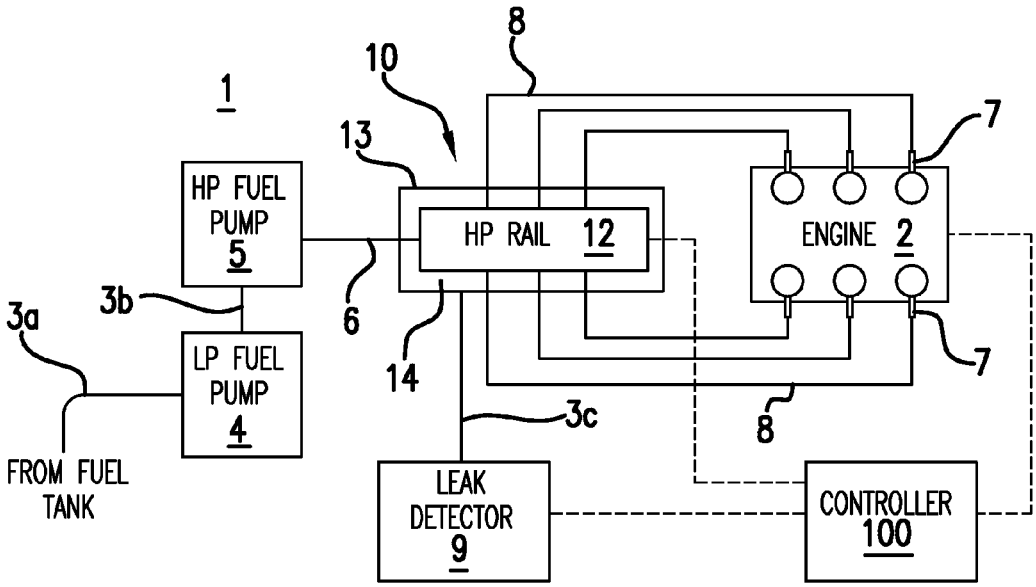
FIG. 1 is a block diagram of an engine system including an enclosure for a high pressure fuel rail according to an exemplary embodiment.

FIG. 1 is a diagram of an engine system 1 including an enclosure for a high pressure fuel rail according to an exemplary embodiment. As shown in FIG. 1, engine system 1 includes an internal combustion engine system 2 and a fuel system that includes low pressure fuel lines 3*a*-3*c*, a low pressure (LP) fuel pump 5, a high pressure (HP) fuel pump 5, a high pressure fuel rail encapsulation assembly 10 including a high pressure rail 12 fluidly connected to the HP pump 5 via high pressure fuel line 6 and to plural fuel injectors 7 fluidly coupled to cylinders of the internal combustion engine system 2 via high pressure fuel lines 8, and an enclosure portion 13 that sealingly surrounds the entire high pressure rail 12, but allows high pressure fluid passages of the high pressure fuel lines 7 and 8 to pass through the enclosure portion 13 to the HP rail 12. The enclosure portion 11 of the high pressure fuel rail encapsulating assembly 10 sealingly engages the high pressure fuel lines 7 and 8 and forms a low pressure region 14 between the HP rail 12 and the inner surface of the enclosure portion 11. The low pressure region 12 of the high pressure fuel rail encapsulation assembly 10 is fluidly connected to a leak detector 9 via low pressure fuel line 3*c*. The leak the detector 9 is connected to a controller 100, such as an electronic control module (ECM) or electronic control unit (ECU) that monitors and controls the engine and fuel system functions of the engine system 1, or another controller. While not shown, controller 100 can be communicatively connected with other components of the engine system, such as the HP fuel pump 5, the fuel injectors 7, an EGR system, and an exhaust aftertreatment system (not shown) in a known manner to monitor and control various engine system functions.

In operation, the engine system 1 draws fuel from a fuel tank or reservoir (not shown) through a low pressure fuel line 3*a*. The fuel output from the LP pump 4 can be passed through a filter (not shown) before being provided to the HP fuel pump 5. The HP pump 5 receives the fuel at low pressure and provides fuel at high pressure to the HP rail 12 via a high pressure fuel line segment 6. The HP rail 12 provides fuel at a substantially equalized high pressure to each of the high pressure fuel lines 8 that are fluidly connected to a respective fuel injector. While six high pressure lines 8, respective injectors 7, and engine cylinders are shown in the exemplary engine system 1, other applications can include more or less high pressure lines 8 and corresponding injectors 7 and engine cylinders.

The high pressure fuel lines 6 and/or 8 connected to the fuel rail 12 of the high pressure fuel rail encapsulating assembly 10 can have a double (dual) wall configuration, such as described in U.S. application Ser. No. 13/103,066, where leaked fuel from a high pressure line is contained in a low pressure passage between an outer and inner wall of the double walled fuel line structure. Fuel leaking from fuel lines (e.g., fuel leaking from joints (interfaces) and high pressure fuel line ruptures) on the injector side of the fuel rail can be directed into the low pressure region 14 of the encapsulating assembly 10 and thereafter directed to another destination, such as a detection device. In an embodiment, for example, leaked fuel can be directed from the high pressure fuel rail encapsulating assembly 10 by low pressure fuel line fluidly connected to the enclosed space of the low pressure region 14 and then directed to the fuel pump, and from the pump fed to a separate detection system or device (e.g., a leak detection tank). The detection system or device senses the leakage and activates or triggers an alarm mechanism via the controller 100, such as indication on a display, an audible alarm, ODB code, and/or another alarm indication. In an embodiment, leaked fuel from the injector side high pressure connector can be brought into the enclosure portion 11 by way of a double wall fuel line and the same fuel can be directed to the fuel pump by another double wall fuel line, and from the fuel pump it is separated from the main fuel circuit and fed to a leak detection system. The lead detection system senses the leaked fuel and triggers the alarm.

Figure 2A:
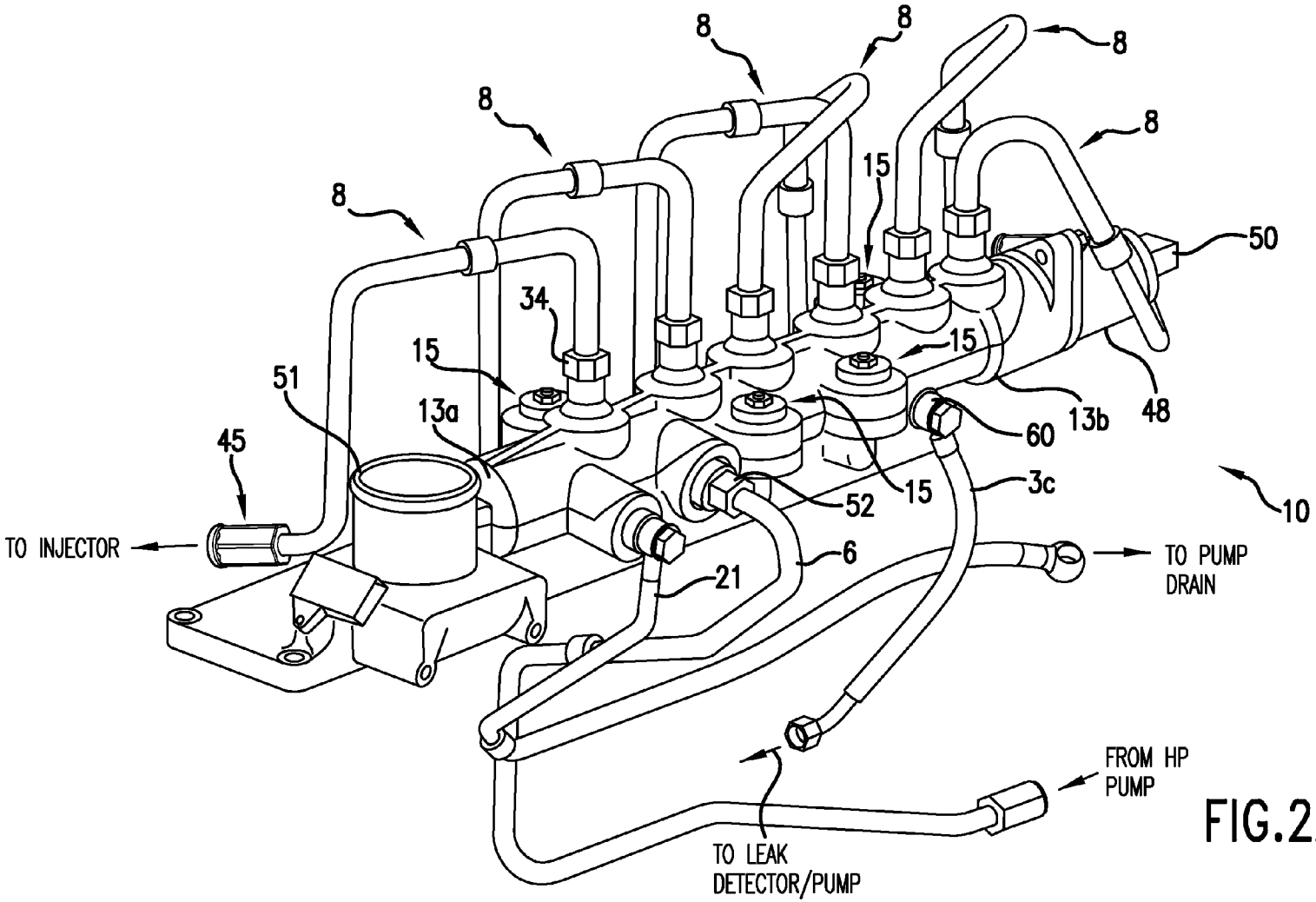
FIG. 2A is a perspective view diagram of an assembled high pressure fuel rail encapsulation assembly according to an exemplary embodiment.
Figure 2B:
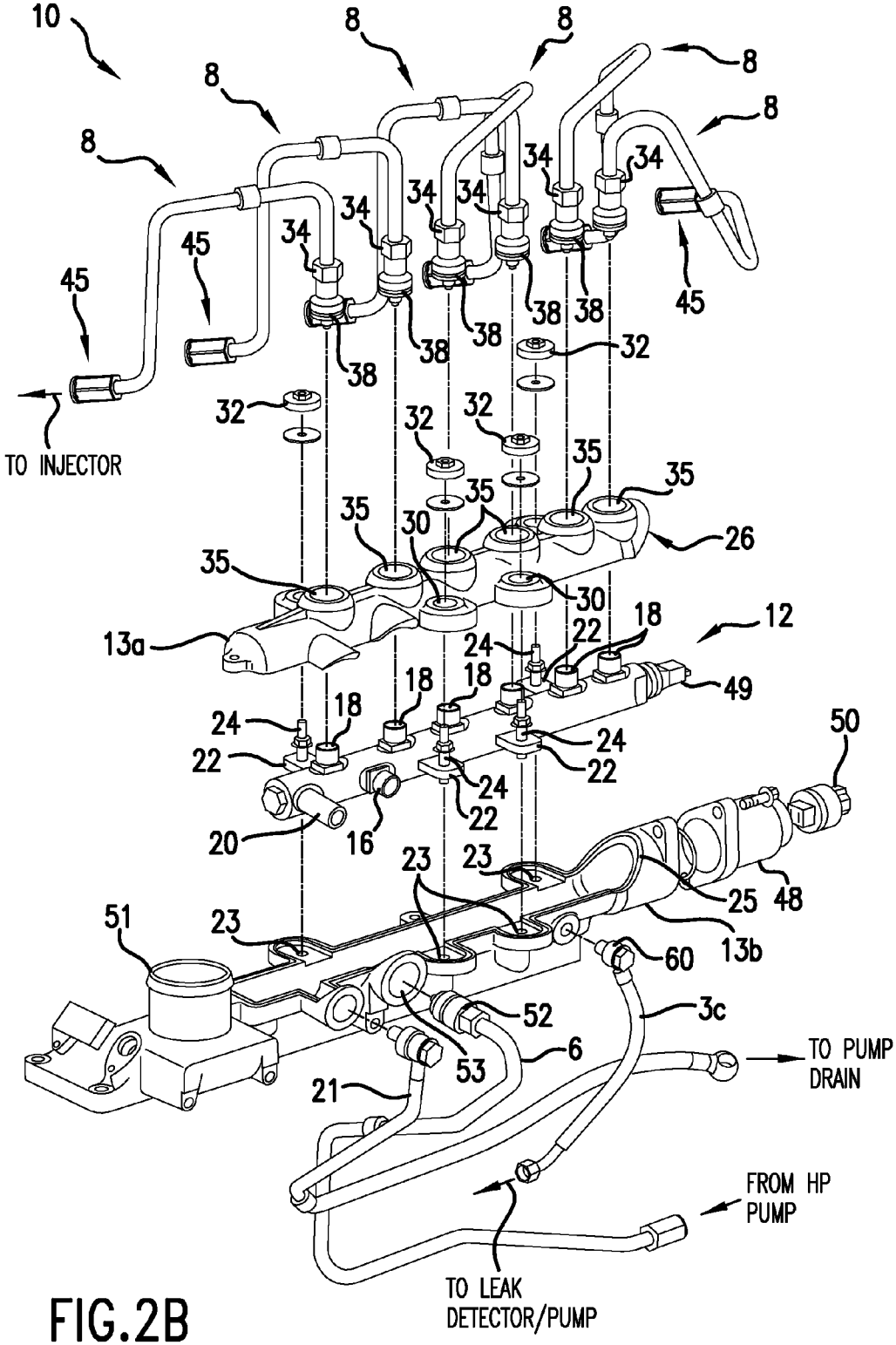
FIG. 2B is an exploded perspective view diagram of the high pressure fuel rail encapsulation assembly shown in FIG. 2A.

FIG. 2A is a diagram showing more details of an assembled high pressure fuel rail encapsulation assembly 10 according to an exemplary embodiment. FIG. 2B is an exploded view of the encapsulation assembly 10 shown in FIG. 2A. As shown in FIGS. 2A and 2B, the encapsulation assembly is a box type enclosure with an upper portion 13*a* and a lower portion 13*b* that fit around and on a high pressure fuel rail 12 sealing it completely from atmosphere to form a generally annular shaped low pressure enclosure between the fuel rail and the adjacent inner walls of the encapsulation assembly 10. The upper portion 13*a* and lower portion 13*b* are secured to one another via studded cap screw assemblies 15, although the portions 13*a*/13*b* can be secured to one another and the high pressure fuel rail 12 via another type of attachment means.

The fuel rail 12 can be essentially of known design having an elongated tubular shaped body and include a high pressure inlet port 16 configured to attach a high pressure supply line 6 from a high pressure pump 5 (see FIG. 1), plural high pressure outlet ports 18 for attaching high pressure fuel lines 8, and a rail drain outlet port 20 for attaching a fuel rail drain line 21 to the pump drain. The high pressure fuel rail 12 includes attaching members 22 extending from its body for attaching and suspending the fuel rail 12 within the enclosure formed by the high pressure fuel rail encapsulating assembly 10. When assembling the encapsulation assembly 10, the high pressure fuel rail 12 can be positioned in the lower portion 13*b* with through holes in the attaching members 22 aligned with threaded holes 23 in the lower portion 13*b*. The attaching members 22 can be secured to the lower portion 13*b* by screwing a studded cap screw 24 into each of the threaded holes 23.

Figure 3:
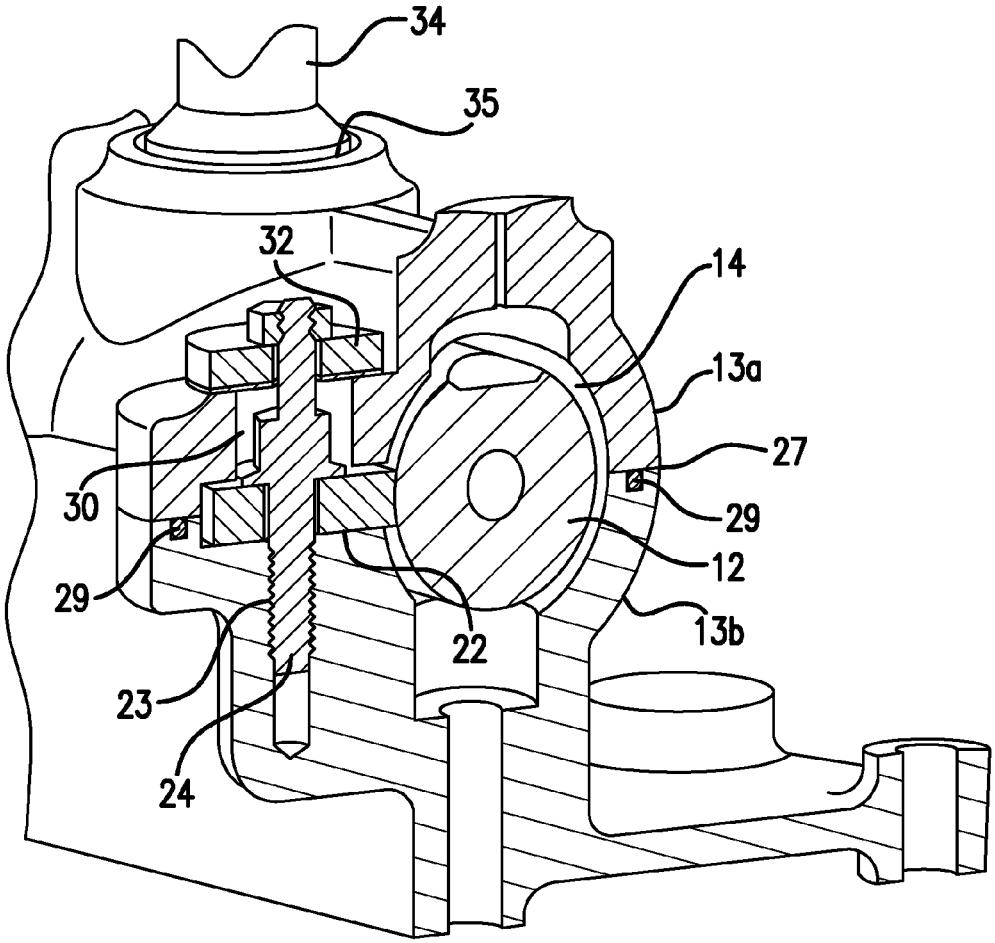
FIG. 3 is a diagram showing a cross section of a portion of the assembled high pressure fuel rail encapsulation assembly shown in FIG. 2A taken across a plane perpendicular to the longitudinal axis of the high pressure fuel rail.

With reference to FIG. 2B and FIG. 3, the lower portion 13*b* includes a sealing flange surface 25, and the upper portion 13*a* includes a sealing flange surface 26. The lower portion 13*b* and sealing flange surface 25 can be brought together in a sealing engagement to form an interface 27 when assembling the high pressure fuel rail encapsulation assembly 10. The sealing flange surface 25 of the lower portion 13*b* can include a groove 28 for inserting an O-ring 29, which can be a gasket having a diamond-shaped cross-section, although the sealing flange surface 26 of the upper portion 13*a* can include such a groove for the O-ring/gasket. Alternatively, the upper portion 13*a* can include a sealing flange surface and groove instead of, or together with the lower portion 13*b*, a flat gasket can be provided between sealing flange surfaces of the upper portion 13*a* and lower portion 13*b*, the upper and lower portions 12, 13 can be welded, or another sealing mechanism used. As shown in FIG. 3, each studded cap screw 24 can include a stud portion that extends through an opening 30 in the upper portion 13*a*, and a weld nut washer assembly 32 can secure the upper portion 13*a* to the lower portion 13*b* without touching the fuel rail 12. This arrangement can ensure positive sealing between the upper portion 13*a* and the lower portion 13*b* of the high pressure fuel rail encapsulation assembly 10 to enclose the high pressure fuel rail 12 and maintain a low pressure region 14 in the form of an annular gap between the fuel rail 12 and the upper portion 13*a* and lower portion 13*b* for collecting leaked fuel from the fuel lines 6 and/or 8 or any other portion of the rail or associated fitting within the low pressure region. While an annular gap is shown in the exemplary embodiment of FIGS. 2A-3, it is to be appreciated that a low pressure gap or volume within the enclosure formed by the upper and lower portions 13*a*, 13*b*, and the fuel rail 12 does not necessarily have an annular shape.

Figure 4:
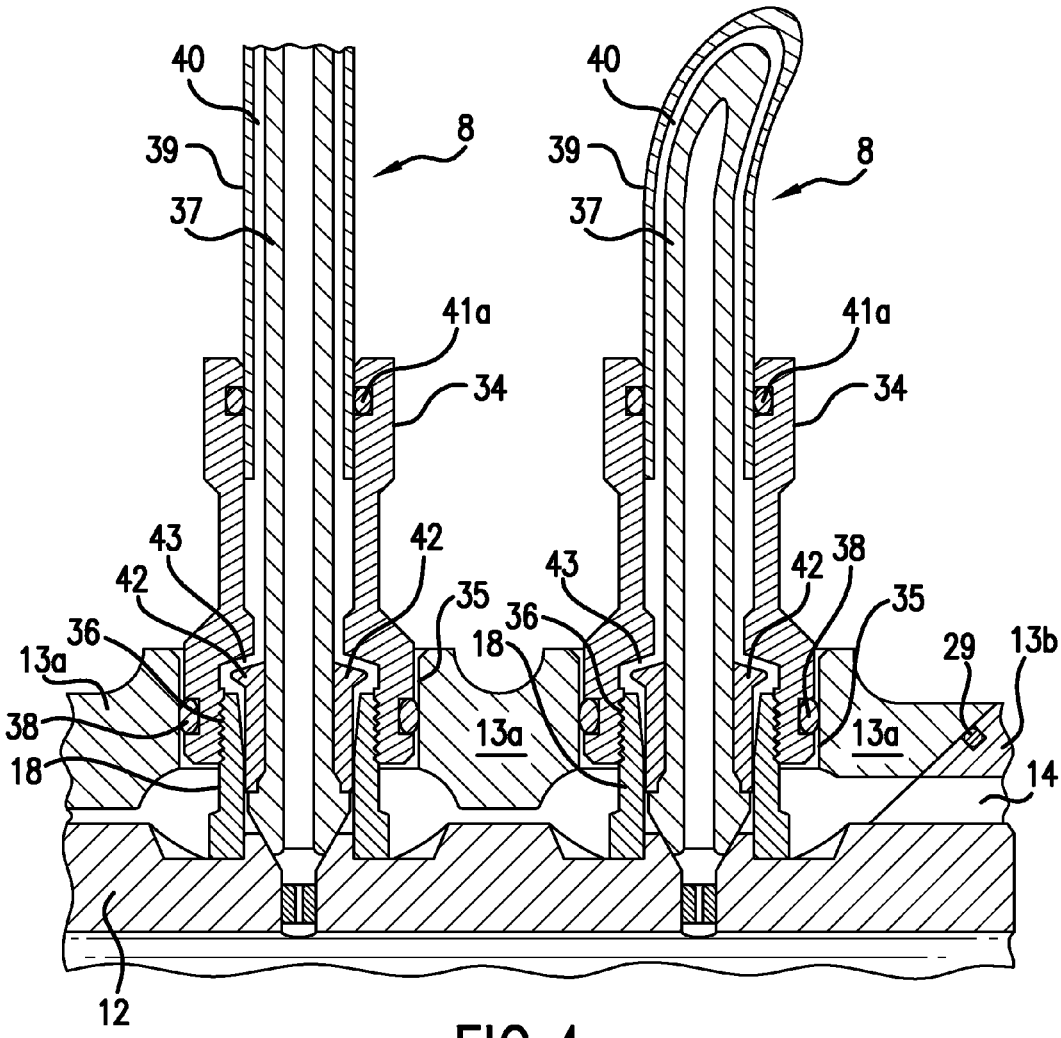
FIG. 4 is a diagram showing a cross section of an upper portion of the assembled high pressure fuel rail encapsulation assembly shown in FIG. 2A taken across a plane parallel to the longitudinal axis of the high pressure fuel rail.

FIG. 4 is a diagram showing a detailed cross sectional view of exemplary fuel line connections to an upper portion of a fuel rail 12. As shown in FIG. 4, each fuel line 8 includes has one end connected to a fuel injector 7 (see FIG. 1) and another end in sealing engagement with the high pressure fuel rail outlet port 18 via a fuel line connector 34. The high pressure fuel rail encapsulation assembly 10 has provision for separately sealing each of the fuel line connectors 34 with the upper portion 13*a* of the encapsulation assembly 10. In an embodiment, each fuel line 8 can be a multiple-walled line, such as a double or triple walled configuration, in which an innermost high pressure passage or tube is secured to form an interface with a fuel passage of an injector 7 at one end thereof and to a high pressure outlet port 18 of the high pressure fuel rail 12 at another end thereof.

Each high pressure fuel line connector 34 can form a seal with the upper portion 13*a* of the encapsulation assembly 10 by inserting the fuel line connector 34 through a respective cylindrical opening, or port 35 provided in the upper portion 13*a* and screwing a threaded inner surface 36 of the fuel line connector 34 to a threaded surface of the high pressure fuel rail outlet port 18. As the high pressure fuel line connector 34 is screwed onto the high pressure fuel rail outlet port 18, a collar 42 that supports the high pressure inner tube 37 is urged downward direction in the figure such that a mating surface of the high pressure fuel rail outlet port 18 is pressed into sealing engagement with a surface of the inner high pressure fuel line 37 of the fuel line 8, which is shown in the exemplary embodiment as having a conical cross section. An O-ring 38 forms a seal between the cylindrical opening 35 and the fuel line connector 34 for sealing of the low pressure region 14 including the annular gap and one or more low pressure passage in each fuel line 8.

As shown in FIG. 4, the low pressure passage(s) in each fuel line 8 is formed by the high pressure inner fuel line, or tube 37 and an outer sheathing, jacket or tube 39 surrounding the high pressure inner tube 37. The inner high pressure tube 37 and outer tube 39 form an annular shaped low pressure region 40 between them, although more than one such low pressure region or passage can be provided using one or more additional concentric outer tubes. The outer tube 39 is sealed at the fuel line connector 34 via an O-ring 41*a* to provide a continuous low pressure fluid path from the low pressure region 40 through the fuel line connector 34. The collar 42 that supports the high pressure inner tube 37 can include grooves 43 configured to allow leaked fuel in the low pressure region 40 to pass across the collar 42. Also, inherent gaps in the fuel rail at the threaded boss connector of the high pressure ports 16, 18 or grooves formed in these areas can be used as leak paths for leaked fuel to flow into the low pressure region 14 formed by the encapsulation assembly 10.

Figure 5:
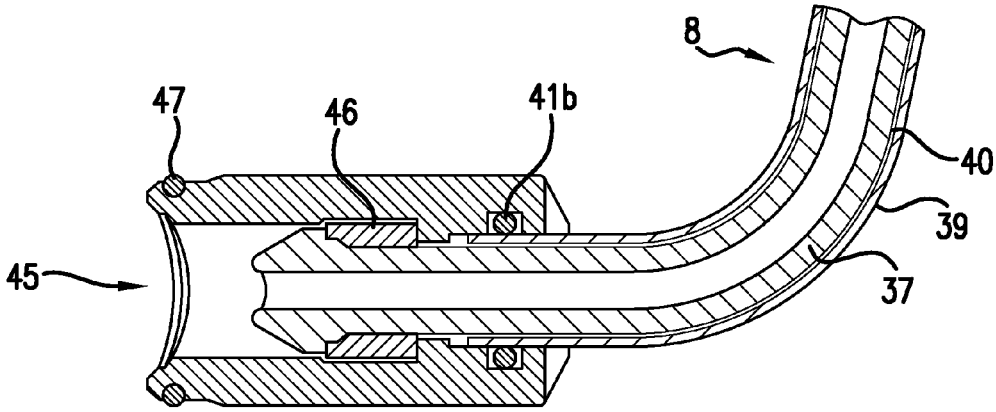
FIG. 5 is a diagram showing a cross section of a high pressure fuel line connector at the injector side of the high pressure fuel line shown in FIGS. 2A and 2B.

Referring now to FIG. 5, a connector 45 at the high pressure connector (HPC) side (injector side) of the fuel line 8 is shown in cross section. The connector 45 includes an O-ring 41*b* for sealing the volume between outer tube 39 and inner high pressure tube 37 from the atmosphere to provide the low pressure region 40 at the injector side of the fuel line 8 in which fuel leaking from the high pressure connection can be contained. The connector 45 includes a support collar 46 for the high pressure inner tube 37. The support collar 46 can include grooves (not shown) configured to allow leaked fuel to flow back in the low pressure region 40 of the fuel line 8. An O-ring 47 seals against the HPC nut of the injector assembly (not shown).

Returning to FIGS. 2A and 2B, the high pressure fuel rail encapsulation assembly 10 includes an end cap 48 that seals a pressure sensor 49 for sensing the pressure of the high pressure fuel rail 12. A sealed wire pass-through 50 is provided on the end of the cap to enable communication of the electrical signal from the sensor indicating a pressure value to the controller 100 (see FIG. 1), such as an ECM/ECU or other controller while keeping the system sealed from the atmosphere.

To allow for efficient spatial packing on an engine, some embodiments can integrate the high pressure fuel rail encapsulation assembly 10 with other engine system components, such as an intake manifold, although such integration of the upper portion 13*a* and lower portion 13*b* of the encapsulation assembly 10 is not necessary. For instance, FIGS. 2A and 2B show an air inlet port 51 merged into the bottom portion 13*b* of the encapsulation assembly 10. In the present embodiment, the intake manifold cover is merged or integrated with the lower portion 13*b* of the encapsulation assembly 10.

The connector 52 of the high pressure supply line 6 can include an O-ring sealing assembly similar to the fuel line connector 34 to provide seal from the atmosphere along the sidewalls the opening 53 in the lower portion 13*b*. Any other high pressure fuel line including high pressure fuel passage surrounded by a low pressure region can connect to a port on the fuel rail 12 utilizing a similar configuration such that a network of low pressure regions including the low pressure region 14 are fluidly connected and include essentially the entire high pressure fuel system.

Thus, a fuel leak that may develop in the high pressure fuel line would be contained in the passage of the low pressure region 40 and in the low pressure region 14 to provide a fluid path that is sealed from the atmosphere such that leaked fuel can be collected in an enclosure provided by the high pressure fuel rail encapsulation assembly 10. Collected leaked fuel is thereafter directed to the low pressure leak drain line 3*c*, which fluidly connects at one end thereof to the encapsulating assembly 10 utilizing a banjo style connector 60 (see FIGS. 2A and 2B) and at its other end to a leak detector (see FIG. 1), which can be a fluid detection system or device. The low pressure leak drain line 3*c* can alternatively provide leaked fuel to a fuel pump, which may or may not detect fuel leakage, and/or from the fuel pump fed to a separate leakage detection system or device.

Figure 6:
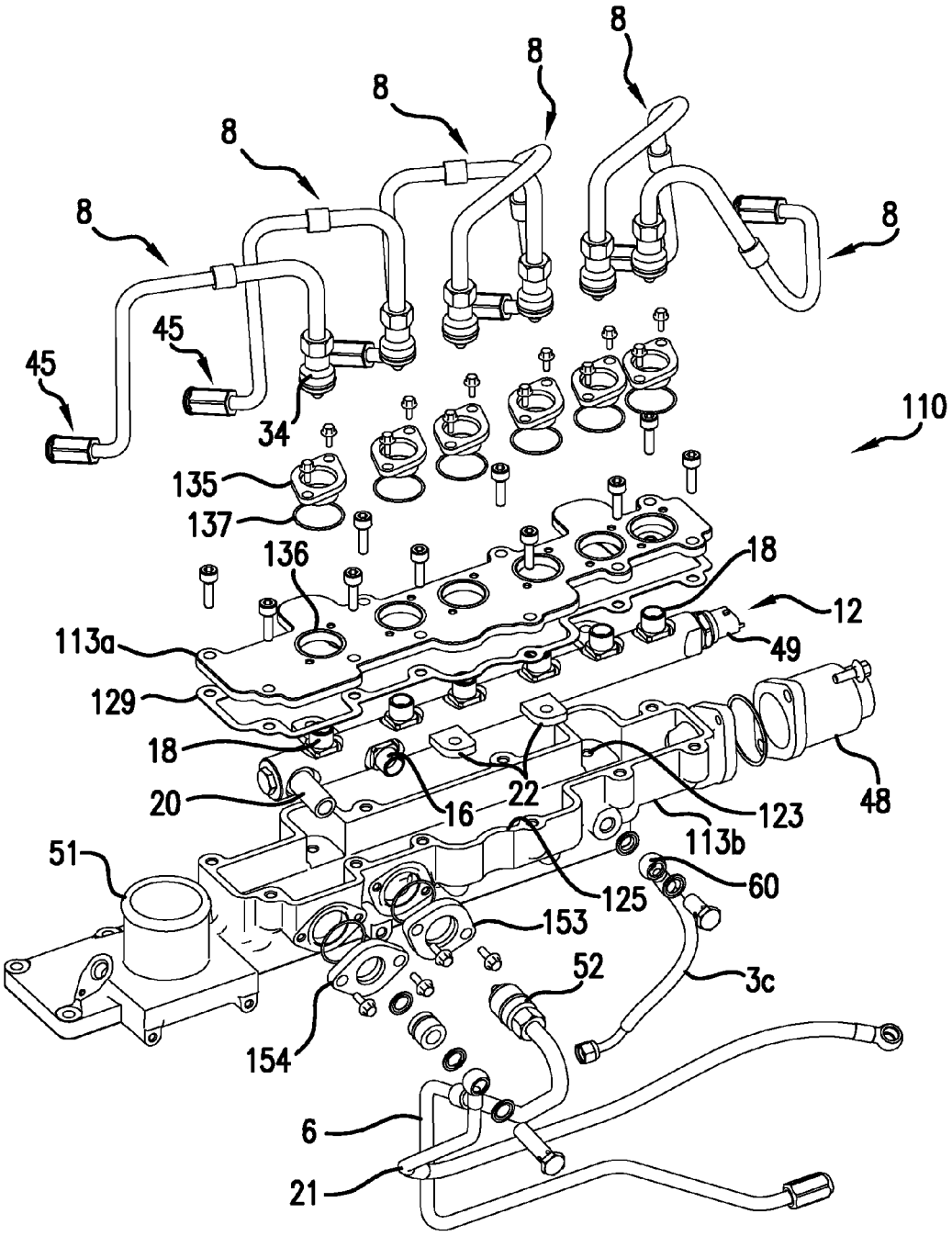
FIG. 6 is an exploded perspective view diagram of a high pressure fuel rail encapsulation assembly according to an exemplary embodiment.

FIG. 6 is an exploded view diagram showing a high pressure fuel rail encapsulation assembly 110 according to another exemplary embodiment. Reference should be made to the description above with respect to elements of the high pressure fuel rail encapsulation assembly 110 having the same element reference numbers as elements previously described. As can be seen from FIG. 6, the lower portion 113*b* of encapsulation assembly 110 has a tub-like shape having a greater interior volume capacity compared with the encapsulation assembly 10. The upper portion 113*a* is substantially flat, or disposed in a plane that is generally perpendicular to sidewalls of a compartment formed by the upper and lower portions 113*a*, 113*b*, and sealingly attaches to the lower portion 113*b* via a gasket 129 to form a compartment, cavity or enclosure into which the high pressure fuel rail 12 is provided.

The attaching members 22 of the high pressure fuel rail 12 are secured to threaded holes in lands 123 provided in the lower portion 113*b*. The lands 123 are recessed from an upper surface 125 of the lower portion 113*b* to at least an extent necessary for the fuel rail 12 not to interfere with the upper portion 113*a*. The O-ring of each of the high pressure fuel line connectors 34 seals against a respective sleeve element 135. Each sleeve element 135 is inserted into a respective opening 136 provided in the upper portion 113*a* with a gasket 137 therebetween to form a port above a respective high pressure outlet port 18. Similarly, sleeve elements 153 and 154 are provided in openings in a side surface of the lower portion 113*b* to form ports that are respectively aligned with the high pressure inlet port 16 and the rail drain outlet port 20 of the fuel rail 12, and receive the respective high pressure drain line 21 and high pressure fuel line 6.

As described above, the embodiment shown in FIG. 6 includes a high pressure fuel rail encapsulation assembly 110 that is integrated with an intake manifold 51. However, it is to be understood that embodiments consistent with the disclosure can be implemented without any such integration, or integrated with engine system components (not shown) other than an intake manifold.

Embodiments consistent with the disclosure provide a low pressure enclosure that encloses the high pressure fuel rail entirely, and can serve as a reservoir for collecting fuel leaking from the high pressure fuel lines and fuel line connector interfaces (e.g., leakages at the joints or as a result of line ruptures) and comply with current and future governmental marine agency mandates related to fuel containment.

Although a limited number of embodiments is described herein, one of ordinary skill in the art will readily recognize that there could be variations to any of these embodiments and those variations would be within the scope of the disclosure.

What is claimed is:

1. A containment assembly for a high pressure fuel system, comprising:

a first elongated portion having a first opening and adapted to receive a high pressure fuel rail having an elongated body, an inlet port, plural outlet ports, and a connecting member extending from the elongated body, said first elongated portion including a fastener portion configured to secure the connecting member of the high pressure fuel rail within the opening of the first elongated portion, a fuel inlet port adapted to sealingly engage a high pressure fuel line connector that connects to the inlet the high pressure fuel rail, and a leaked fuel drain port adapted connect to a low pressure fuel leakage drain line upstream of a leak detector; and a second portion adapted to cover and seal the first opening to form an enclosed compartment including a low pressure region between the high pressure fuel rail and inner surfaces of said compartment, said second portion including plural ports, each of said plural ports adapted to sealingly engage a respective high pressure fuel line connector including a high pressure fuel line and a low pressure passage, and to align with a high pressure outlet port of the high pressure fuel rail, wherein with the plural fuel line connectors sealingly engaged with the respective plural ports, each low pressure passage of the high pressure fuel line connectors fluidly communicates with the enclosed low pressure region.

2. The containment assembly according to claim 1, wherein the containment assembly forms a portion of an intake manifold cover.

3. The containment assembly according to claim 2, wherein said first elongated portion includes an intake air port.

4. The containment assembly according to claim 1, wherein the first elongated portion includes:

an end portion including a second opening; and a cap portion adapted to sealingly cover the second opening and allow electrical communication to the interior of the enclosure.

5. The containment assembly according to claim 1, wherein the compartment entirely surrounds the high pressure fuel rail, and said opening exposes substantially the entire length of said high pressure fuel rail prior to covering said first portion with said second portion.

6. The containment assembly according to claim 5, wherein the second portion includes a major surface that is substantially disposed in a plane, and the compartment has sidewalls that are substantially perpendicular to said plane.

7. The engine system of claim 1, wherein each of the ports in the first elongated portion and each of the ports in the second elongated portion corresponding to a high pressure fuel line includes a cylindrically shaped sidewall surface adapted to engage with a sealing member of an outer surface of a respective high pressure fuel line connector to provide said sealing engagement.

8. An engine system, comprising:

an internal combustion engine including plural cylinders and an intake manifold;

a fuel system including:

a high pressure fuel rail including an inlet port and plural outlet ports;

plural fuel injectors, each said injector adapted to inject fuel at high pressure into one of the cylinders;

a high pressure fuel inlet line fluidly connected to the inlet port of the fuel rail; and plural high pressure fuel outlet lines, each said high pressure fuel outlet line fluidly connected at a first end thereof to one of the fuel injectors and fluidly connected at a second end thereof to one of the outlet ports of the fuel rail;

an enclosure housing the fuel rail, including:

a first elongated portion having an opening provided along a direction of a longitudinal axis of the first elongated portion, a first surface surrounding said opening, a region recessed from the first surface, a second elongated portion having a second surface that sealingly engages with the first surface to cover and seal the opening, plural ports provided through the enclosure, each of the plural ports aligned with a corresponding one of the inlet port and the plural outlet ports of the enclosed high pressure fuel rail, and a leaked fuel drain port fluidly connected to a low pressure fuel leakage drain line; and a leak detector fluidly connected to the low pressure fuel leakage drain line downstream from the enclosure housing and adapted to detect whether fuel is present in the low pressure fuel leakage drain line, wherein each of the high pressure fuel outlet lines and the high pressure fuel inlet lines include a connector at one end, a high pressure fuel passage, and a corresponding low pressure leaked fuel passage, and each of the connectors is sealingly engaged with the one of the plural ports of the enclosure to form a low pressure region in the enclosure substantially surrounding the high pressure fuel rail.

9. The engine system of claim 8, wherein the fuel rail includes a connecting member extending from a side portion of the high pressure fuel rail and fastened to said first elongated portion of the enclosure.

10. The engine system of claim 9, wherein a fastening member utilized to fasten the connecting member to the enclosure is also utilized to fasten the second elongated portion to the first elongated portion and provide said sealing engagement between the first and second surfaces.

11. The engine system of claim 8, wherein with the plural fuel line connectors sealingly engaged with the respective plural ports, each low pressure passage of the high pressure fuel line connectors fluidly communicates with the enclosed low pressure region in the enclosure.

12. The engine system of claim 8, wherein each of the ports in the enclosure includes a cylindrically shaped sidewall surface that engages with a sealing member of an outer surface of the connector to provide said sealing engagement.

13. The engine system of claim 8, further comprising:

a controller communicatively connected to the leak detector; and an alarm, wherein the controller triggers the alarm with detection of fuel in the low pressure region.

14. The engine system of claim 8, wherein the enclosure forms a portion of the intake manifold.

15. The engine system according to claim 14, wherein the first elongated portion includes an intake air port.

16. The engine system according to claim 8, wherein the first elongated portion includes:

a second opening provided at one distal end of the elongated portion and having a center axis substantially coincident with a longitudinal axis of the fuel rail; and a cap portion adapted to sealingly cover the second opening and allow electrical communication to the interior of the enclosure.

17. The engine system according to claim 8, wherein each of the high pressure fuel outlet lines and the high pressure fuel inlet lines are double walled high pressure fuel lines.

* * * * *